United States Patent [19]

Larson

[11] Patent Number: 4,641,840

[45] Date of Patent: Feb. 10, 1987

[54] ELECTRONIC PLAYING DIE

[76] Inventor: Kim A. Larson, P.O. Box 5051, Fullerton, Calif. 92635

[21] Appl. No.: 776,487

[22] Filed: Sep. 16, 1985

[51] Int. Cl.[4] ..... A63F 9/04

[52] U.S. Cl. ..... 273/138 A; 273/146

[58] Field of Search ..... 273/146, 138 A, 143 R, 273/161

[56] References Cited

U.S. PATENT DOCUMENTS 4,181,304 1/1980 Haber ..... 273/146

FOREIGN PATENT DOCUMENTS 3238373 4/1984 Fed. Rep. of Germany ... 273/138 A 383237 12/1964 Switzerland ..... 273/143 R

OTHER PUBLICATIONS

Penfold, R. A., "Digital Dice", *Radio and Electronics Constructor*, 9/78, vol. 32, No. 1, pp. 14–18.

*Primary Examiner*—Richard C. Pinkham

*Assistant Examiner*—Stuart W. Rose

*Attorney, Agent, or Firm*—Edgar W. Averill, Jr.

[57] ABSTRACT

A plastic cube supports a seven-segment numeric display on each of its six facets. Within the cube, an electronic circuit including a random number generator and motion sensing switch are supported. During cube motion, the electronic circuit is operative to impress various numbers on the numeric displays. Once motion ceases, the last occurring number is displayed on all six numeric displays.

11 Claims, 4 Drawing Figures

ELECTRONIC PLAYING DIE

BACKGROUND OF THE INVENTION

The present invention relates generally to playing dice and more particularly to playing dice of the type having illuminated, numeric displays.

Random selection devices such as dice have been utilized in various amusement games and games of chance for an extended period of time. Originally, such dice were simply small, solid cubes having numbered facets. Typically, the various games of chance and entertainment in which dice found application relied upon the activity of rolling the dice across a surface and applying significance or importance to the number displayed on the upwardly facing facet of the cubes once they came to rest. While such solid dice continue to be utilized in numerous games of chance and entertainment devices to this day, the advent of electronic circuitry and illuminatable numeric displays for use in conjunction, therewith, has created the opportunity to produce more advanced types of dice. Such "electronic dice" add the additional entertainment and interest element of illuminatable, numeric display segments on the dice facets.

A number of such electronic playing dice have bee created by those skilled in the art. For example, U.S. Pat. No. 4,181,304 sets forth an illuminated dice and storage housing combination in which a pair of playing dice are provided with light-emitting diodes on their interior surfaces, together with a battery and master switch within each die. A gravity-responsive switch within the die causes the battery to be coupled to the upward facing facet of the die thereby illuminating only the upwardly facing facet numeric display. A storage housing includes means for charging the internal batteries of each of the die during periods of non-use.

U.S. Pat. No. 4,431,189 sets forth an electronically simulated die system in which an electronic circuit housed within an elongated playing device contains internal logic circuitry which simulates the rolling action of conventional non-electronic dice. Means are provided for simulating dice behavior characteristic of other device structures such as four-sided, eight-sided, twelve-sided, twenty-sided, or even one-hundred-sided dice.

U.S. Pat. No. 4,124,881 sets forth illuminating means within a pair of multifaceted dice. Each of the facets bear an illuminatable, numeric display and each supports an internal illumination device which operates to illuminate the uppermost facet of the dice after having been rolled and coming to rest.

U.S. Pat. No. 4,034,988 sets forth an electronic dice game in which an electronic circuit is supported within a housing having two sets of opto-electric display elements on the housing face to represent the spot sets of a conventional set of dice. The electronic circuit includes timing means which provide a random activity characteristic of the random rolling of conventional dice. In its intended use, the electronic dice of the '988 patent simulate the dice-playing activity by randomly generating combinations of illuminated spot elements on the single display facet.

U.S. Pat. 4,148,488 sets forth a random selection apparatus which comprises a sealed cube having six transparent surfaces surrounding a second smaller cube supported therein which includes the conventional six spot sets of a die. Each facet of the internal cube is maintained in alignment with a corresponding transparent window of the outer cube. An opaque liquid occupies the space between the side and bottom facets and windows of the two cubes, but not the upward facing facet and window. As a result, none of the faces of the inner cube are viewable through the windows of the outer cube except the upwardly facing facet.

U.S. Pat. No. 3,791,650 sets forth a simulated dice game and control circuit therefor in which a playing board includes a plurality of display lamps arranged in a pattern corresponding to the spot patterns on two dice. The display lamps are activated by an electronic circuit which produces a random pattern of illumination on the lamps, and which thereby is utilized to simulate the action of a pair of rolling dice.

U.S. Pat. No. 2,881,892 sets forth a game apparatus in which a cube is provided with conventional dice spot patterns for the numbers two through six on the side and upper facets and which includes means for sequentially illuminating each of the spot patterns on the facets in a rapid, serial manner. The player attempts to activate a manually-operable breaking device which stops the movement of the facet illuminating selector. The object is to apply the breaking device with sufficient skill to select the illumination pattern desired.

U.S. Pat. No. 3,459,427 and U.S. Pat. No. 3,715,624 set forth similar early attempts to combine electronic circuitry with playing dice, and each includes a random pattern generator which randomly illuminates the spot patterns typical of playing dice in a manner intended to approximate the action of playing dice described above.

While the foregoing playing dice provide some level of amusement and interest, there remains a need in the art for an electronically operated playing die in which increased excitement is created by the interaction of the die rolling and the random number generation of the electronic circuit.

SUMMARY OF THE INVENTION

Accordingly, it is an object of the present invention to provide an improved electronic playing die. It is a more particular object of the present invention to provide an improved electronic playing die which combines the interest of electronic circuitry and the action of conventional playing dice in a new and exciting manner.

In accordance with the present invention, there is provided a multi-faceted housing such as a cube having a numeric display on each facet thereof and electronic circuit means for generating a number sequence together with means for displaying the number generated on the facets of the device. A motion-activated switch detects cube motion and causes the number produced by the number generator to be displayed on all facets of the cube once motion of the cube has ceased.

BRIEF DESCRIPTION OF THE DRAWINGS

The features of the present invention which are believed to be novel are set forth with particularity in the appended claims. The invention, together with further objects and advantages thereof, may best be understood by reference to the following descriptions taken in conjunction with the accompanying drawings in the several figures of which like-reference numerals identify like elements, and in which:

DESCRIPTION OF THE PREFERRED EMBODIMENTS

Figure 1:
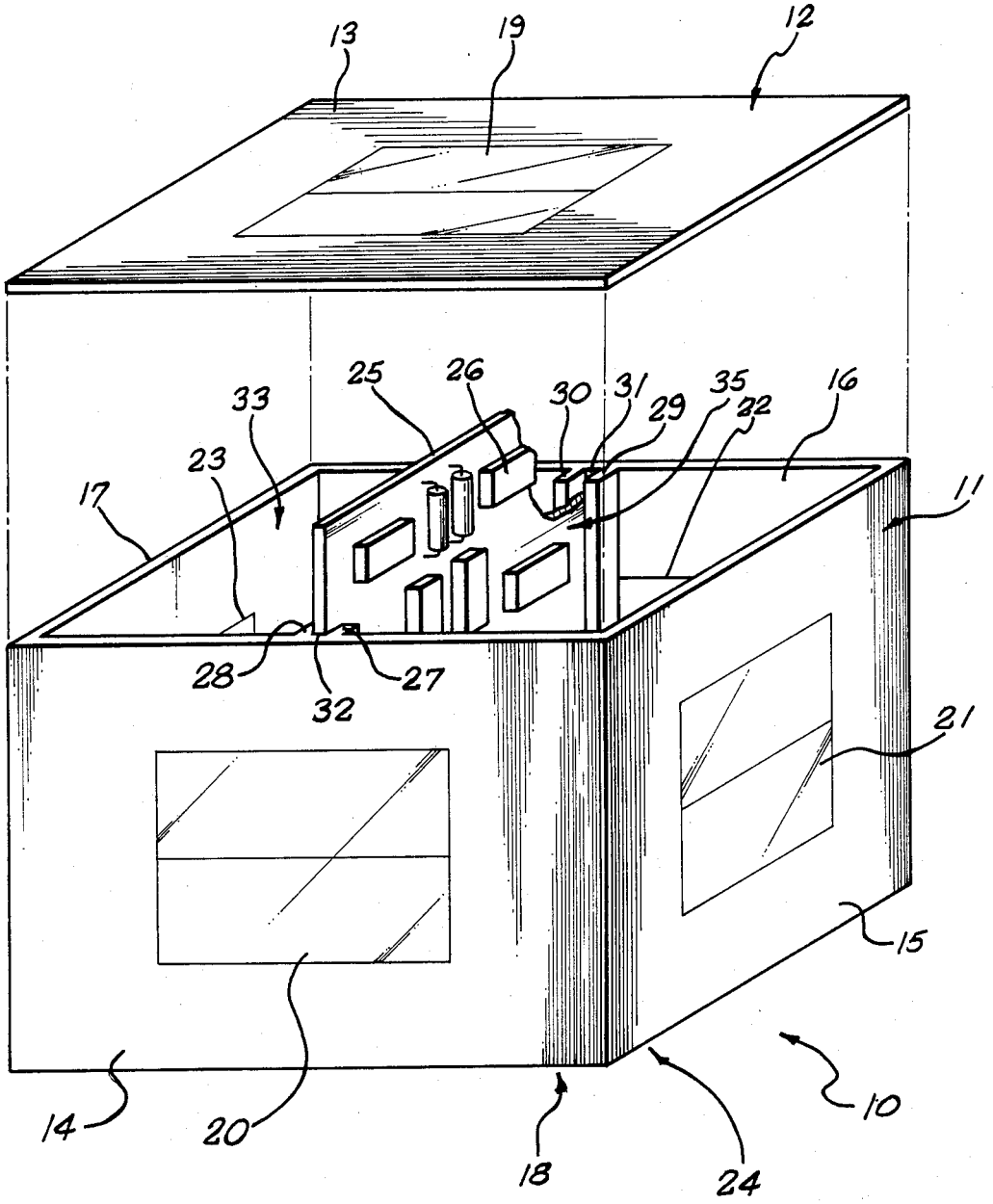
FIG. 1 is an assembly view of an electronic playing die constructed in accordance with the present invention.

FIG. 1 shows an assembly view of the present invention electronic playing die generally referenced by the numeral 10, includes a five-sided housing 11 having a plurality of mutually perpendicular facets 14, 15, 16, 17 and 18 arranged to define five of the six mutually perpendicular facets of a cube and to define a housing cavity 33 therein. A pair of ribs 27 and 28 extend inwardly from facet 14 and are spaced apart by a uniform distance to provide a channel 32 running substantially the entire length of facet 14. In a similar manner, facet 16 defines a pair of inwardly extending elongated ribs 29 and 30, faced approximately opposite ribs 27 and 28 of facet 14 and defining a channel 31 which, in similar manner to channel 32, extends substantially the entire length of facet 16. A circuit board 25, having a substantially planar construction and formed of an insulative material, is constructed in accordance with conventional printed circuit board techniques. Circuit board 25 is sized to fit within channels 31 and 32 of housing 11 and to be supported within cavity 33. Circuit board 25 should be understood to include a conventional insulative substrate together with a plurality of component supporting apertures. A plurality of electronic circuit components 26 are supported upon circuit board 25 and are interconnected by a plurality of conventional printed circuit foil patterns (not shown) in a manner consistent with present printed circuit board fabrication techniques. Components 26 should be understood to comprise the electronic circuit means set forth in greater detail in FIGS. 3*a* and 3*b* below. Components 26 should be further understood to include a conventional battery power source sufficient to energize and maintain the electronic circuit shown in FIGS. 3*a* and 3*b*.

A substantially planar housing cover 12, having a shape and size similar to facets 14 through 18 of housing 11, is affixed to the exposed edges of facets 14, 15, 16 and 17 in a manner to complete the cube structure of playing die 10. Housing cover 12 defines a facet 13 which, in turn, supports a numeric display 19. By means not shown in FIG. 1, but in accordance with conventional fabrication techniques, numeric displays 19 through 24 include means for making electrical connections to selected ones off components 26 on circuit board 25. Numeric displays 19 through 24 comprise conventional seven-element numeric displays constructed in accordance with conventional fabrication techniques and arranged to produce the numerals 0 through 8 by selective activation of segments of the displays.

With housing cover 12 affixed to housing 11 in the foregoing manner, circuit board 25 is captivated within channels 31 and 32 and is thereby securely supported within cavity 33. In accordance with an important aspect of the present invention described below in greater detail, the resulting structure with housing cover 12 securely affixed to housing 11 provides a cube-shaped playing die which may be tumbled across surfaces in a manner similar to that utilized with conventional playing dice.

In brief, the operation of the present invention playing die, as set forth below in greater detail, provides the following:

With the present invention playing die at rest, numeric displays 19 through 24 remain blank, that is, no numeral displayed thereon. When playing die 10 is moved, such as being picked up by a player, means within circuit components 26 respond to the motion and commence activity of the electronic circuit which, among other functions, begins generation of numbers. As playing die 10 continues in motion, as for example, being tumbled across a surface in a manner similar to conventional gaming dice, the operation of the number generator within circuit 25 continues to produce a sequence of numbers which are flashed upon numeric displays 19 through 24. The flashing of numbers on numeric displays 19 through 24 continues so long as playing die 10 remains in motion. Ultimately, with playing die 10 coming to rest and motion ceasing, the motion detection means within playing die 10 respond to the absence of motion and cause the last number generated to be steadily displayed upon all of numeric displays 19 through 24. In accordance with an important aspect of the present invention, it should be noted that the same number is simultaneously displayed on all numeric displays. In addition to causing the display of the selected number on numeric displays 19 through 24, the cessation of motion of playing die 10 also activates an internal timing means which will turn off numeric displays 19 through 24 unless motion is renewed. If, however, prior to such deactivation, playing die 10 is again placed in motion, the foregoing operation is repeated and a new number is displayed on numeric displays 19 through 24 once playing die 10 again comes to rest.

Figure 2:
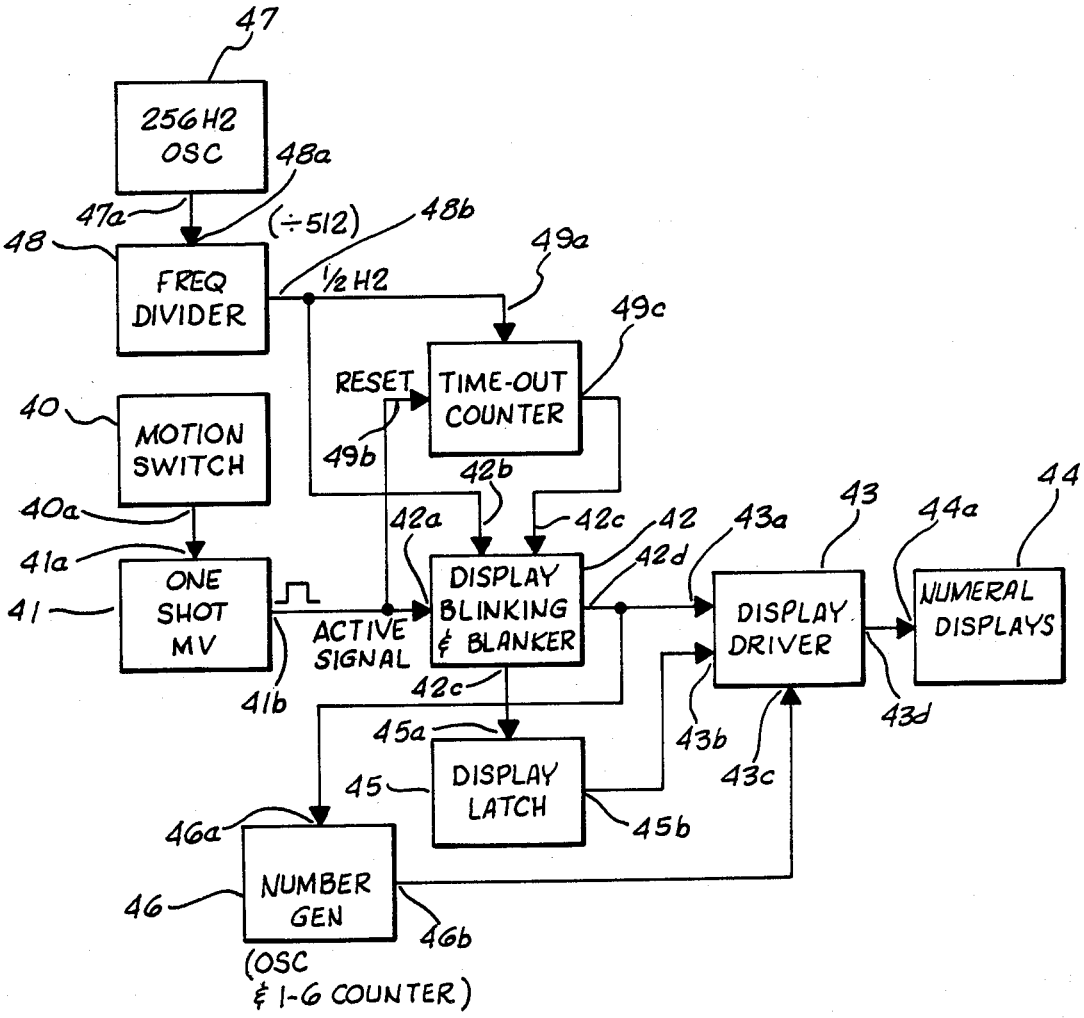
FIG. 2 is a block diagram representation of the operative circuit means of the present invention electronic playing die.

FIG. 2 sets forth a block diagram representation of circuit 35. It should be understood at the outset that the representation in FIG. 2 is an operational block diagram and not a detailed circuit schematic. It should also be understood that the couplings shown between the various block elements in FIG. 2 define signal path interconnections and may typically include multiple electronic connections. The intent in FIG. 2 is to convey an operative sense of the action of circuit 35. Therefore, reference should be made to FIGS. 3*a* and 3*b* below for detailed electrical interconnections.

A motion switch 40 is constructed in accordance with conventional techniques and defines an output terminal 40*a*. A multivibrator 41 defines an input terminal 41*a* connected to terminal 40*a* of motion switch 40 and an output terminal 41*b*. A display control 42 includes an input terminal 42*a* connected to terminal 41*b* and input terminals 42*b* and 42*c* and output terminals 42*d* and 42*e*. An oscillator 47 includes an output terminal 47*a*. A frequency divider 48 includes an input terminal 48*a* connected to terminal 47*a* and an output terminal 48*b*. A counter 49 includes input terminals 49*a* and 49*b* and an output terminal 49*c*. Input terminal 49*a* is connected to output terminal 48*b* which, in turn, is connected to input terminal 42*b* of display control 42. Output terminal 49*c* of counter 49 is coupled to input terminal 49*c* of display control 42. A display driver 43 includes inputs 43*a*, 43*b* and 43*c* and an output 43*d*. A display latch 45 includes an input 45*a* coupled to output 42*e* of display control 42 and an output 45b coupled to input 43b of display driver 43. A numeric display 44a includes an input 44a coupled to output 43d of display driver 43. A number generator 46 includes an input 46a coupled to output 42d of display control 42 and an output 46b coupled to input 43c of display driver 43.

In operation, motion switch 40 produces an output signal each time motion is detected. The output signal from motions switch 40 triggers one-shot multivibrator 41 which generates an output pulse each time motion switch 40 is actuated. In the typical activity of the present invention playing die in which the device is tumbled across a surface, motion switch 40 will be repeatedly activated during the tumbling motion.

Accordingly, with repeated activation of motion switch 40, multivibrator 41 continues to produce a signal at its output 41b. The importance of this signal from multivibrator 41 will be described below in greater detail. However, suffice it to say here that the output signal of multivibrator 41 constitutes a motion-indicating signal. Oscillator 47 produces an output signal at a frequency of 256 Hz which is frequency reduced by frequency divider 48 to a 0.5 Hz signal. This 0.5 Hz signal is applied to both counter 49 and to display control 42. Counter 49 counts the number of the 0.5 Hz signals from frequency divider 48 and upon achieving a predetermined count produces an output signal at output 49c which, in turn, causes display control 42 to turn off display drivers 43. The count which counter 49 must reach to produce the display blanking signal is a matter of design choice. Typically, an interval of ten to thirty seconds is selected. However, because the motion-indicating output signal of multivibrator 41 is applied to the reset terminal 49b of counter 49 in a manner inhibiting counter operation, counter 49 will only commence counting in the absence of the output signal from multivibrator 41. Simply stated, motion of the playing die causes motion switch 40 and one-shot multivibrator 41 to produce a signal which inhibits the action of counter 49 and thereby assures that display control 42 does not turn off display driver 43.

Display control 42 responds to the presence of a motion-indicating signal at input 42a and produces an output signal corresponding to the 0.5 Hz signal applied to terminal 42b. This output signal is coupled to the blanking input terminal 43a of display driver 43. The 0.5 Hz signal at terminal 42d is also applied to input 46a of number generator 46. The latter signal application to terminal 46a causes number generator 46 to begin counting. Each time a signal is applied to terminal 46a, number generator 46 commences a zero to six count producing output signals for the numbers one through six which are coupled to display drivers 43. As a result, display driver 43 receives both a 0.5 Hz blanking signal at terminal 43a and a sequence of generated numbers at terminal 43c. Display control 42 further produces a display latch signal which causes display latch 45 to transfer the number then present at terminal 43c to numeric display 44.

When the present invention playing die comes to rest, motion switch 40 is no longer active and the output signal from multivibrator 41 ceases. In the absence of the activate signal at terminal 42a of display control 42, the last numeric value imposed on numeric display 44 is maintained and the operation of number generator 46 ceases. It should be noted that number generator 46 produces a sequence of numbers in such rapid manner that the effect produced is the same as that of a random number generator. Because the one to six count is so rapid relative to the operation of the motion switch, the number displayed is, in essence, random and for all practical purposes independent of playing die motion. It will be apparent, therefore, that a random number circuit may be substituted for number generator 46 without departing from the scope of the present invention.

In the absence of output signal from multivibrator 41, no reset signal is applied to counter 49, whereupon counter 49 commences the above described counting of the 0.5 Hz signals applied to terminal 49a. In the event motion switch 40 is not activated during the time counter 49 takes to reach the predetermined count, counter 49 produces an output signal at terminal 49c which is operative upon display controller 42 to cause it to turn off display driver 43. In such event, the numeric displays 44 no longer display a number.

Conversely, if motion switch 40 is again activated before counter 49 reaches its predetermined count (indicating continued play), a reset signal will again appear at terminal 49b, and counter 49 will return to zero and restart its count, and display driver 43 remains operative. With motion resumed, motion switch 40 is once again activated causing multivibrator 41 to again produce an output motion-indication signal which, in turn, continues to reset counter 49 and the above-described number generating activity is repeated.

Figure 3A:
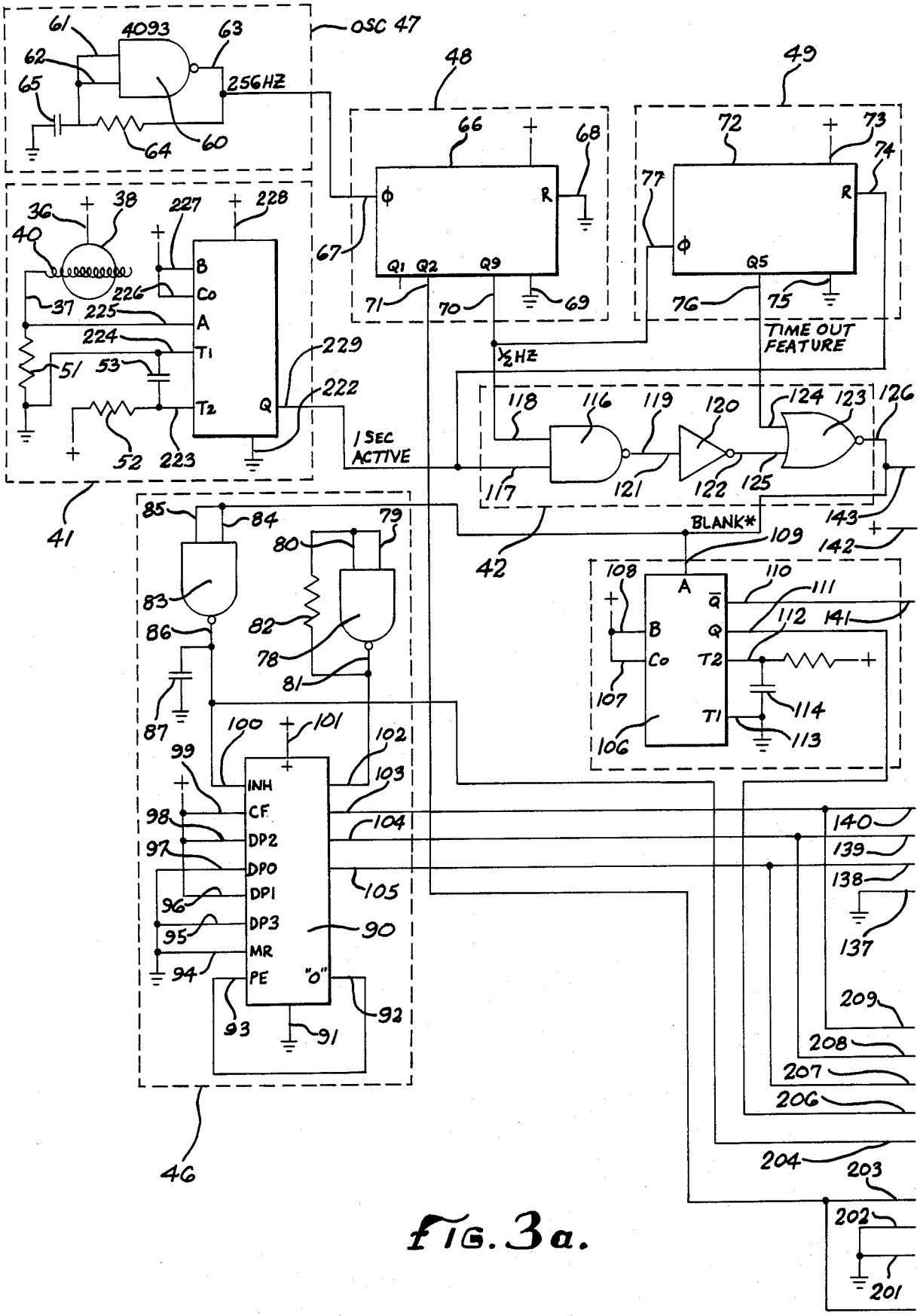
FIGS. 3*a* and 3*b* together comprise a detailed circuit of the preferred embodiment of the electronic circuit of the present invention electronic playing die.
Figure 3B:
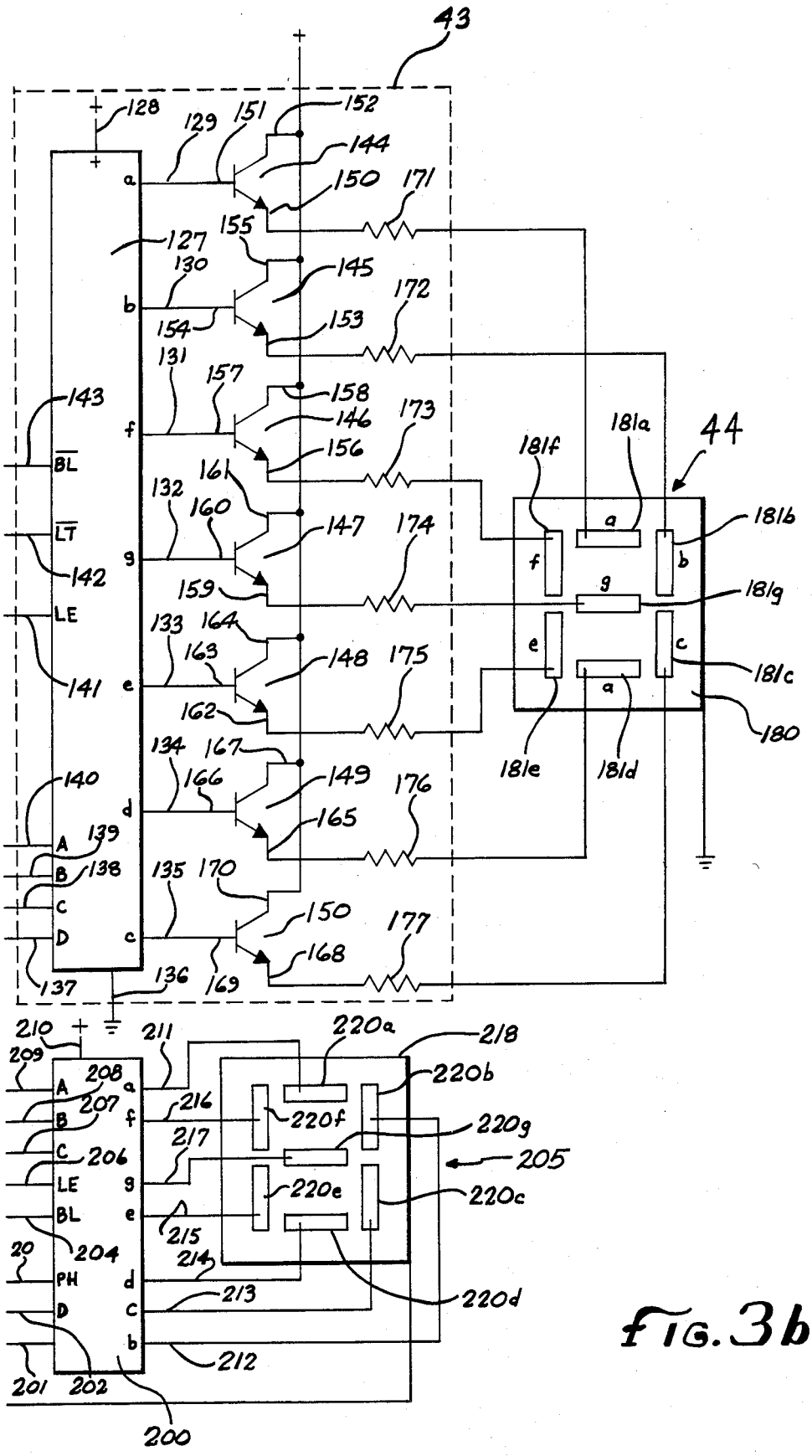

FIGS. 3a and 3b sets forth a detailed schematic diagram of circuit 35. Motion switch 40 comprises a motion sensor 38 and a pair of terminals 36 and 37. In accordance with conventional motion detecting switch fabrication, sensor 38 is operative to conductively couple terminal 36 to terminal 37 each time sensor 38 detects motion of switch 40. Terminal 36 is coupled to a source of operating supply voltage, such as a battery (not shown), and terminal 37 is coupled to ground by a resistor 51. As a result, each time sensor 38 couples terminal 36 to terminal 37, current flows from the operating supply and a voltage appears at the ungrounded side of resistor 51.

An integrated circuit 54 comprises a plurality of conductive terminals 222, 223, 224, 225, 226, 227, 228 and 229. While a number of integrated circuit devices may be utilized for the function of integrated circuit 54, in the preferred embodiment, it comprises a device having the generic device number 4538. Terminal 222 is connected to ground, while terminal 228 is coupled to a source of operating supply voltage. In similar manner, terminals 226 and 227 are commonly coupled to a source of operating supply voltage. Terminal 225 is coupled to the ungrounded end of resistor 51, while terminal 224 is connected to ground. A capacitor 53 is coupled between terminals 223 and 224 and a resistor 52 couples terminal 223 to a source of operating supply voltage. It should be noted that while the terminals on the various integrated circuit devices shown in FIGS. 3a and 3b are numbered and referred to by "patent drawing numbers" in the descriptions which follow, the functional designations such as "Q," "T1," "T2," and the pin numbers 6, 1, and 2, respectively, and so on, are also shown in FIGS. 3a and 3b. By way of example, terminal 227 of integrated circuit 54 is also marked as both the "B" terminal and pin 5 while terminal 229 is the "Q" terminal and pin 6. This redundant marking is maintained in FIGS. 3a and 3b to aid the reader in understanding the interconnections of devices in the drawing. However, the descriptions which follow will refer to integrated circuit device terminals solely by their patent drawing numbers.

A NAND gate 60 has a pair of input terminals 61 and 62 and an output terminal 63. A resistor 64 is coupled between output terminal 63 and commonly coupled input terminals 61 and 62. A capacitor 65 couples input terminals 61 and 62 to ground. The resulting configuration of NAND gate 60 provides a relaxation type oscillator in which a periodic signal, the frequency of which is substantially controlled by resistor 64 and capacitor 65, is produced at output terminal 63. An integrated circuit 66 having a generic device number 4040 includes terminals 67, 68, 69, 70 and 71. Terminal 67 of integrated circuit 66 is coupled to output terminal 63 of NAND gate 60 and terminals 68 and 69 are coupled to ground. An integrated circuit 72 has a terminal 73 coupled to a source of operating potential, a reset terminal 74, a terminal 75 coupled to ground, an output terminal 76 and an input terminal 77. The latter is coupled to terminal 70 of integrated circuit 66. Integrated circuit 72 may be formed of several comparable devices; however, in the preferred embodiment, it comprises a device having the generic number 4040.A NAND gate 116 has an input terminal 117 coupled to terminal 229 of integrated circuit 54 and to terminal 74 of integrated circuit 72, an input terminal 118 coupled to terminal 70 of integrated circuit 66 and an output terminal 119. An inverting amplifier 120 has an input terminal 121 coupled to terminal 119 of NAND gate 116 and an output terminal 122. A NOR gate 123 has an input terminal 125 coupled to output terminal 122 of inverter 120, an input terminal 124 coupled to terminal 76 of integrated circuit 72 and an output terminal 126.

An integrated circuit 127 having a generic device number 4511 has a terminal 128 connected to a source of operating potential and a plurality of output terminals 129 through 135, a terminal 136 connected to ground, a terminal 137 connected to ground, a trio of input terminals 138, 139 and 140, an input terminal 141, a terminal 142 connected to a source of operating supply voltage and a terminal 143 connected to output terminal 126 of NOR gate 123.

An output transistor 144 has an emitter electrode 150, a base electrode 151 coupled to terminal 129 and a collector electrode 152 coupled to a source of operating potential. An output transistor 145 has an emitter electrode 153, a base electrode 154 coupled to terminal 130 and a collector electrode 155 coupled to a source of operating potential. An output transistor 146 has an emitter electrode 156, a base electrode 157 coupled to terminal 131 and a collector electrode 158 coupled to a source of operating potential. An output transistor 147 has an emitter electrode 159, a base electrode 160 coupled to terminal 132 and a collector electrode 161 coupled to a source of operating supply. An output transistor 148 has an emitter electrode 162, a base electrode 163 coupled to terminal 133 and a collector electrode 164 coupled to a source of operating potential. An output transistor 149 has an emitter electrode 165, a base electrode 166 coupled to terminal 138 and a collector electrode 167 coupled to a source of operating potential. An output transistor 150 has an emitter electrode 168, a base electrode 169 coupled to terminal 135 and a collector electrode coupled to a source of operating potential.

A numeric display 44 has a common back plane electrode 180 and a plurality of illuminatable segments 181*a* through 181*g*, inclusive. A resistor 171 couples emitter 150 to display segment 181*a*. A resistor 172 couples emitter 153 to display segment 181*b*. A resistor 173 couples emitter electrode 156 to display segment 181*f*. A resistor 174 couples emitter 159 to display segment 181*g*. A resistor 175 couples emitter electrode 162 display segment 181*e*. A resistor 176 couples emitter 165 to display segment 181*d*. A resistor 177 couples emitter electrode 168 to display segment 181*c*.

An integrated circuit 106 having a generic device type number 4538 has a pair of terminals 107 and 108 commonly coupled to a source of operating potential, a terminal 109 coupled to terminal 126 of NOR gate 123, a terminal 110 coupled to terminal 141 of integrated circuit 127, a terminal 111, a terminal 112 coupled to a source of operating supply voltage by a resistor 115 and a terminal 113 connected to ground. A capacitor 114 couples terminal 112 to ground.

A NAND gate 78 has a pair of input terminals 79 and 80 and an output terminal 81. A resistor 82 couples input terminals 79 and 80 to output terminal 81. A NAND gate 83 has a pair of input terminals 84 and 85 commonly coupled to terminal 109 of integrated circuit 106 and an output terminal 86 coupled to ground by a capacitor 87. An integrated circuit 90 has a terminal 91 coupled to ground, a terminal 92, a terminal 93 coupled to terminal 92, a pair of terminals 94 and 95 coupled to ground, a terminal 96 coupled to a source of operating potential, a terminal 97 coupled to ground and a pair of terminals 98 and 99 coupled to a source of operating potential, a terminal 100 connected to terminal 86 of NAND gate 83, a terminal 101 connected to a source of operating potential, a terminal 102 connected to terminal 81 of NAND gate 78 and terminals 103, 104 and 105 coupled to terminals 140, 139 and 138, respectively, of integrated circuit 127.

An integrated circuit 200 has a pair of terminals 201 and 202 coupled to ground, a terminal 203 coupled to terminal 71 of integrated circuit 66, a terminal 204 coupled to terminal 100 of integrated circuit 90, a terminal 206 coupled to terminal 111 of integrated circuit 106, a trio of terminals 207, 208 and 209 coupled to terminals 105, 104 and 103, respectively, of integrated circuit 90, a terminal 210 connected to a source of operating potential, and output terminals 211 through 217, inclusive. A liquid crystal display 205 includes a common back plane electrode 218 and a plurality of display segments 220*a* through 220*g*, inclusive. Display segments 220*a* through 220*g* are coupled to terminals 211 through 217, respectively.

It should be noted that while the circuit of FIGS. 3*a* and 3*b* is shown operable using both liquid crystal displays (LCD) 205 and light emitting diode (LED) displays 44, in its expected embodiment, either LED or LCD displays, but not both, are used. It will be equally apparent to those skilled in the art that while a single numeric display is shown for LCD and LED, multiple numeric displays, such as display 44, which are electrically connected in parallel are used in the actual fabrication of the present invention die. For example, in the six-faceted cube embodiment shown in FIG. 1, numeric displays 19 through 25 are supported on each cube facet and should be understood to be connected in parallel to numeric display 44 or 205, having their respective segments A through G connected to display driver 43 in the same manner as those segments shown for numeric display 44 if an LED embodiment is used, or in the alternative, in the same manner as the segments A through G of numeric display 205 in their connection to integrated circuit 200. It will be equally apparent to those skilled in the art that a numeric display in the preferred embodiment is supported on each facet of the playing die. Playing die 10 may, of course, have any number of facets without departing from the spirit and scope of the present invention.

In operation, the circuit of FIGS. 3*a* and 3*b* operates in accordance with digital electronic functions. That is to say, the various elements are active in either of two voltage states. The greater or more positive is referred to as "high" while the lesser or less positive is referred to as "low." Initially, with motion switch 40 open and playing die 10 at rest, the output of terminal 229 of multivibrator 41 is low. Once motion switch 40 senses motion, a positive voltage is produced at terminal 225 of multivibrator 41, resulting in the production of a high signal of approximately one second's duration at terminal 229. Mulitvibrator 41 is capable of accepting successive "trigger" signals at 225 which switch the output signal high in the event that it existed at a low condition at the time of triggering or will maintain the output signal at a high level if already in a high state. As a result, the output signal at terminal 229 comprises an active signal indicating motion of the playing die. This active signal is supplied to input 117 of NAND gate 116.

NAND gate 60, resistor 64 and capacitor 65 comprise a relaxation type oscillation circuit in which the values of resistance and capacitance are selected to produce a 256 Hertz (Hz) signal at output 63 of NAND gate 60. This 256 Hz signal is applied to input terminal 67 of frequency divider 48. In accordance with well known techniques, frequency divider 48 produces a 64 Hz signal at terminal 71 and a 0.5 Hz signal at terminal 70. The latter is applied to input 118 of NAND gate 116. NAND gate 116 produces a low signal each time both inputs 117 and 118 are simultaneously high and a high signal under all other input conditions. As a result, the output of NAND gate 116 switches from high to low voltage states at a 0.5 Hz rate whenever switch 40 detects motion.

Inverter 120, constructed in accordance with conventional amplifier techniques, inverts the output signal at terminal 119 of NAND gate 16 and applies it to input 125 of NOR gate 123. As a result, the condition presented to NOR gate 123 is the opposite in terms of the active signal. That is, the presence of a high signal at input 125 of NOR gate 123 is an indication of cube motion. The 0.5 Hz signal at terminal 70 of integrated circuit 66 is, in addition to coupling to NAND gate 116, further applied to input 77 of integrated circuit 72 within counter 49. Counter 49, as described above, provides an automatic shutoff count. The active signal from one-shot multivibrator 41 is applied to input 74 of integrated circuit 72 which is the reset function. As a result, the function of counter 49 proceeds to accumulate a count of the 0.5 Hz signals produced by frequency divider 48, and upon achieving a specified count indicating a predetermined length of time without motion activity, a signal produced at terminal 76 of integrated circuit 72 is applied to terminal 124 of NOR gate 123. In this manner, a high signal is presented at both inputs of NOR gate 123 during the time counter 49 is accumulating a count and the active signal from multivibrator 41 is applied to reset terminal 74. In essence, counter 49 is counting 0.5 Hz signals from the frequency divider 48 and being simultaneously reset by the applied active signal at terminal 74. Accordingly, counter 49 does not reach its predetermined count so long as active signal is present in the system indicating switch motion. The 0.5 Hz signal applied to input 125 of NOR gate 123 under these circumstances causes the output at terminal 126 of NOR gate 123 to alternate between high and low voltage conditions. This alternating signal applied to terminal 143 of integrated circuit 127 causes the output signals applied to the selected segments of numeric display 44 to be alternately turned on and turned off or blinked at a 0.5 Hz rate.

If on the other hand counter 49 receives a sufficient number of 0.5 Hz signals at terminal 77, in the absence of an active signal at terminal 74, the predetermined count is ultimately reached, and the output signal at terminal 76 goes high. This high signal is coupled to input 124 of NOR gate 123 and causes its output signal at terminal 126 to remain low so long as the high condition remains at terminal 124. The low signal condition at terminal 126, coupled to terminal 143 of integrated circuit 127, turns off the display driver and numeric displays. This shutoff will continue until active signals indicating cube motion are again present in the system. As can be seen, this shutoff function serves a very important purpose in conserving battery power, particularly if the higher power consuming LED displays are used.

Returning to descriptions of the circuit operation, during the presence of an active signal, and recalling that the active signal produces a blinking of numeric displays 44, the operation of number generator 46 will now be described. Number generator 46 includes a NAND gate 78 having its input and output terminals regeneratively coupled by resistor 82 to produce an oscillator having a frequency of approximately 2 Kilohertz (KHz). The output signal of NAND gate 78 is applied to the clock input 102 of a counter integrated circuit 90. Integrated circuit 90 is constructed in accordance with well known fabrication techniques and performs to accumulate a count of input clock signals applied to terminal 102. Because of the configuration of interconnections of integrated circuit 90, it is operative in the presence of output signals from NAND gate 78 to continuously count through the numbers 1 through 6 on a repeated basis so long as input signal is present. Terminals 103, 104 and 105 of integrated circuit 90 are coupled to the numeric inputs 140, 139 and 138 of display driver integrated circuit 127, respectively. The output signal at terminals 103 through 105 is a 3-digit digital signal which defines the numbers 1 through 6 being counted by integrated circuit 90.

This repeated counting of numbers 1 through 6 of integrated circuit 90 continues so long as the above-described operation is taking place to provide blinking of integrated circuit 127 by NOR gate 123. In the event, however, the motion stops and motion switch 40 remains opened, active signals cease, resulting in counter 49 turning off integrated circuit 127. In accordance with the foregoing descriptions, the low signal applied to terminal 143 of integrated circuit 127 is further coupled to a NAND gate 83 within number generator 46. NAND gate 83 inverts the applied low signal to a high signal which is applied to inhibit terminal 100 of integrated circuit 90 causing an interruption in the counting of integrated circuit 90 and a corresponding interruption of output signals at terminals 103, 104 and 105. This inhibition of number generator 46 is a further battery-saving operation in accordance with the foregoing shutdown procedure.

Returning again to the operation of the system in the presence of active signals and turning to the operation of integrated circuit 127, it should be noted that during the above-described blinking action, integrated circuit 127 is receiving a continuously changing set of number inputs at terminals 140, 139 and 138, as well as a blinking signal onto terminal 140. As a result, a series of numbers 1 through 6 is being sequentially displayed on numeric displays 44 and the illumination of the display segments is being blinked. The blinking operation continues so long as motion switch 40 is operative and an active signal is present within the system.

At some point, the playing die comes to rest, and as described above, motion switch 40 becomes inoperative. Accordingly, the active signal no longer appears at counter 49 and the predetermined count is again carried forward causing a low signal applied at terminal 43 of integrated circuit 127. This low signal stops the blinking operation of integrated circuit 127 and causes NAND gate 83 to turn off number generator 46. In addition, however, this low signal is further applied to display latch 45. Display latch 45 includes an integrated circuit 106 which, in accordance with well known fabrication techniques, is configured to produce a short duration pulse signal upon a low condition at terminal 109. This short duration pulse signal (approximately ten microseconds) appears at terminal 110 and is coupled to the latch input 141 of integrated circuit 127. As a result, upon the attainment of the predetermined count, and in the absence of further active signals indicating the playing die has come to rest, the appearance of the ten microsecond pulse at latch input 141 causes integrated circuit 127 to latch. Once integrated circuit 127 latches, the then present input number combination at terminals 138 through 140 is translated to the appropriate output terminal combination of output terminals 129 through 135. This combination of signals, in turn, activates the appropriate ones of output transistors 144 through 150 causing illumination of the selected ones of elements A through G of numeric display 44 to display the number corresponding to the then present count impressed on integrated circuit 127. In other words, while the die is rolling or otherwise in motion, the display continuously blinks, impressing a sequence of 1 through 6 numbers upon numeric display 44. Once the playing die comes to rest, counter 49 reaches its predetermined count and turns off the 1 through 6 oscillator and causes the display drivers to display the last appearing number on the numeric displays 44 in a continuous fashion.

While the foregoing operational description has set forth the performance of the present invention system in connection with display driver 43 and numeric display 44, it will be apparent to those skilled in the art that the same operation is achieved in the alternative event that display driver integrated circuit 200 and numeric display 205 are substituted for the LED arrangement of the above descriptions.

What has been shown is a novel, highly entertaining electronic playing die in which a traditional playing die of "dice rolling" is carried forward by the player with the enhanced entertainment and excitement provided by the flashing of an electronically driven numeric display and the chance selection of a final number for display upon the facets of the playing die. As will be apparent to those skilled in the art, the present invention electronic playing die may be constructed with virtually any number of facets and any die construction, limited only by the players' preferences.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An electronic playing die for use by a player in tumbling said electronic playing die across a playing surface, said electronic playing die comprising:

an insulative housing defining an interior and a plurality of external facets;

a plurality of electrically operable numeric displays, each capable of displaying a selected one of a plurality of numbers in response to a coded electrical signal, supported on at least some of said facets in said plurality of external facets; and circuit means, supported within said insulative housing interior and coupled to said plurality of numeric displays, including means responsive to motion of said electronic playing die for selecting a common number independent of die position and for causing said numeric displays to display said common number on said plurality of numeric displays following cessation of playing die motion.

2. An electronic playing die as set forth in claim 1 wherein said circuit means includes blinking means responsive to motion of said electronic playing die for causing said plurality of numeric displays to blink rapidly during playing die motion.

3. An electronic playing die as set forth in claim 2 wherein said circuit means includes a number generator responsive to playing die motion for producing a rapid sequence of numbers and means for applying said rapid sequence of numbers to said numeric displays during numeric display blinking.

4. An electronic playing die as set forth in claim 3 wherein said circuit means includes means responsive to playing die motion for disabling said blinking means and number generator in the absence of playing die motion for a predetermined interval.

5. An electronic playing die as set forth in claim 1 wherein said circuit means includes:

a motion switch responsive to playing die motion;

a multivibrator coupled to said motion switch producing an active signal during playing die motion;

an oscillator producing a clock signal;

a frequency divider, coupled to said oscillator, producing frequency divided signal lower in frequency than said clock signal;

a number generator producing a sequence of electrical signals representative of numeric digits;

a display driver, coupled to said plurality of numeric displays and said number generator;

a display blinking and blanker circuit coupled to said multivibrator, said frequency divider, and said display driver; and a display latch coupled to said display blinking and blanker circuit.

6. An electronic playing die comprising:

an insulative multi-faceted housing having a number display on each facet thereof; and circuit means for causing rapid blinking of said numeric displays during playing die motion and for causing a single number selected by chance which is independent of playing die position to be simultaneously displayed on all the number displays at each cessation of playing die motion.

7. An electronic playing die as set forth in claim 6 further including means for sensing absence of playing die motion exceeding a predetermined interval and deactivating said circuit means in response thereto.

8. An electronic playing die comprising:

a multifaceted housing defining a plurality of facets and an interior cavity;

a motion sensing means producing an output signal indicative of playing die motion;

a number generator producing a rapidly changing series of electrical signals corresponding to numeric digits;

a plurality of multisegment numeric displays supported on said facets of said multifaceted housing; and a display driver coupled to said motion sensing means and said numeric number generator, causing said numeric displays to simultaneously display the number corresponding to an electrical signal produced by said number generator at interruption of said output signal of said motion sensing means said number displayed being independent of playing die position.

9. An electronic playing die as set forth in claim 8 wherein said housing is a six-faceted cube and wherein said number generator produces a rapid sequence of numbers one through six.

10. An electronic playing die as set forth in claim 9 wherein said numberic displays are light emitting diode displays.

11. An electronic playing die as set forth in claim 9 wherein said numeric displays are liquid crystal displays.

* * * * *